United States Patent [19]

Allardin

[11] Patent Number: 5,016,522

[45] Date of Patent: May 21, 1991

[54] MULTI-STAGE AIR PRESSURE CYLINDER

[76] Inventor: Jean A. Allardin, 2810, Tourterelles, Laval, Quebec, Canada, H7L 3T9

[21] Appl. No.: 370,185

[22] Filed: Jun. 22, 1989

[30] Foreign Application Priority Data

Jul. 4, 1988 [GB] United Kingdom ..... 8815819

[51] Int. Cl.[5] ..... F01B 7/00

[52] U.S. Cl. ..... 92/62; 92/61; 92/151

[58] Field of Search ..... 92/169.1, 61, 62, 65, 92/150, 151

[56] References Cited

U.S. PATENT DOCUMENTS

| | | | |
|---|---|---|---|
| 2,944,520 | 7/1960 | Swanson | 92/151 |
| 2,983,256 | 5/1961 | Seeloff | 92/151 |
| 3,288,036 | 11/1966 | Fisher | 92/151 |
| 3,832,852 | 9/1974 | Schmucker | 92/61 |
| 3,837,765 | 9/1974 | Weise et al. | 92/65 |
| 3,880,051 | 4/1975 | Eppler | 92/151 |

FOREIGN PATENT DOCUMENTS

| | | | |
|---|---|---|---|
| 1155231 | 4/1958 | France | 92/62 |
| 0819486 | 4/1981 | U.S.S.R. | 92/61 |
| 1029636 | 5/1966 | United Kingdom | 92/151 |

*Primary Examiner*—John T. Kwon
*Assistant Examiner*—Thomas Denion

[57] ABSTRACT

A multi-stage air pressure cylinder is made of superposed components tightly fastened together wherein additional stages can be added by superposing additional components. The two-stage cylinder comprises two end wall members each having a cylindrical recess facing each other and divided by a fixed partition wall having a perforation therethrough. The partition wall and the end wall members are tightly fastened together. The partition wall subdivides two compression chambers. A piston is located in each compression chamber. One piston has a projection extending outside the cylinder and the other is adapted to exert a mechanical pressure on the first one while fluid pressure is exerted on both pistons.

10 Claims, 4 Drawing Sheets

MULTI-STAGE AIR PRESSURE CYLINDER

BACKGROUND OF THE INVENTION

Field of the Invention

The invention relates to an air pressure cylinder, and in particular to a multi-stage air pressure cylinder.

The cylinder according to the invention is particularly characterized by an assembly of separate components which are superposed substantially in the form of layers. According to the invention, supplemental stages can be added by the introduction of additional intermediate layers i.e. the introduction of some of the components.

The new cylinder is also characterized by its restricted builkiness which is needed in the robotic field.

The compact shape of the new cylinder facilitates its cleaning operation. It also allows an electroless nickel phosphorous coating on all the piston surfaces, including all the cavities and hard anodize on the surfaces requiring lubrification.

Multipiston pressure cylinders are usually assembled inside a common sleeve of a predetermined length and such a sleeve accepts a predetermined number of pistons. The number of pistons cannot be multiplied. The limitation of such multipiston pressure cylinder is examplied in U.S. Pat. Nos 3,485,141, 3,554,088 and 3,752,040.

In the patent to Ott et al No. 3,485,141, the numbers of piston is limited by the length of the outer sleeve and the inner piston pilot tube. The same applies to the hollow cylindrical body in the patent to Bruyn No 3,554,088 and to the tubular housing in Pat. No. 3,752,040.

SUMMARY OF THE INVENTION

The present invention is directed to a multistage or a multipiston cylinder essentially made of two end walls having an internal recess facing each other and a median partition wall for forming two compression chamber. A piston having an axial shaft are adapted to sealingly slide in each chamber. The shaft of each piston extends in the same direction, one extending through the partition wall and the other through one end wall. The piston having a shaft extending through the partition wall has an axial perforation to allow a flow of air from one chamber to the next. Each end wall has an aperture to allow a passage of air between each of the chambers and the outside of the cylinder. A marginal slot in the periphery of the partition wall allow an air intake in the chamber surrounding the piston provided with an axial perforation for releiving the suction when the latter piston withdraws from a compression stage.

Figure 1:
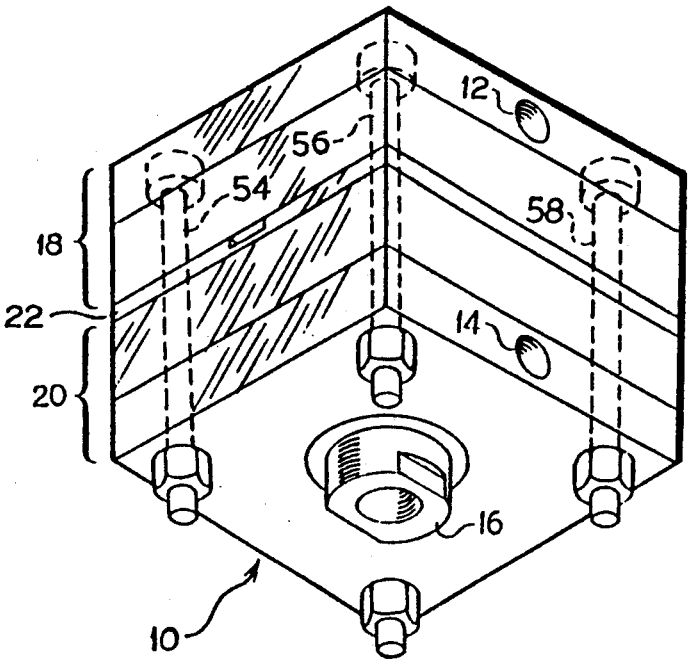
FIG. 1 is a perspective view of a multi-stage air pressure cylinder according to the invention.

DETAILED DESCRIPTION OF THE INVENTION:

FIG. 1 illustrates a two-stage air pressure cylinder in the assembled form. The cylinder 10 is provided with an air inlet 12 and an air outlet 14 adapted to be connected to a pressure valve (not shown) in order to push out the piston 16. If the pressure valve is connected so that the air enters through the aperture 14 and exits through the aperture 12, the piston 16 will be retracted.

Figure 2:
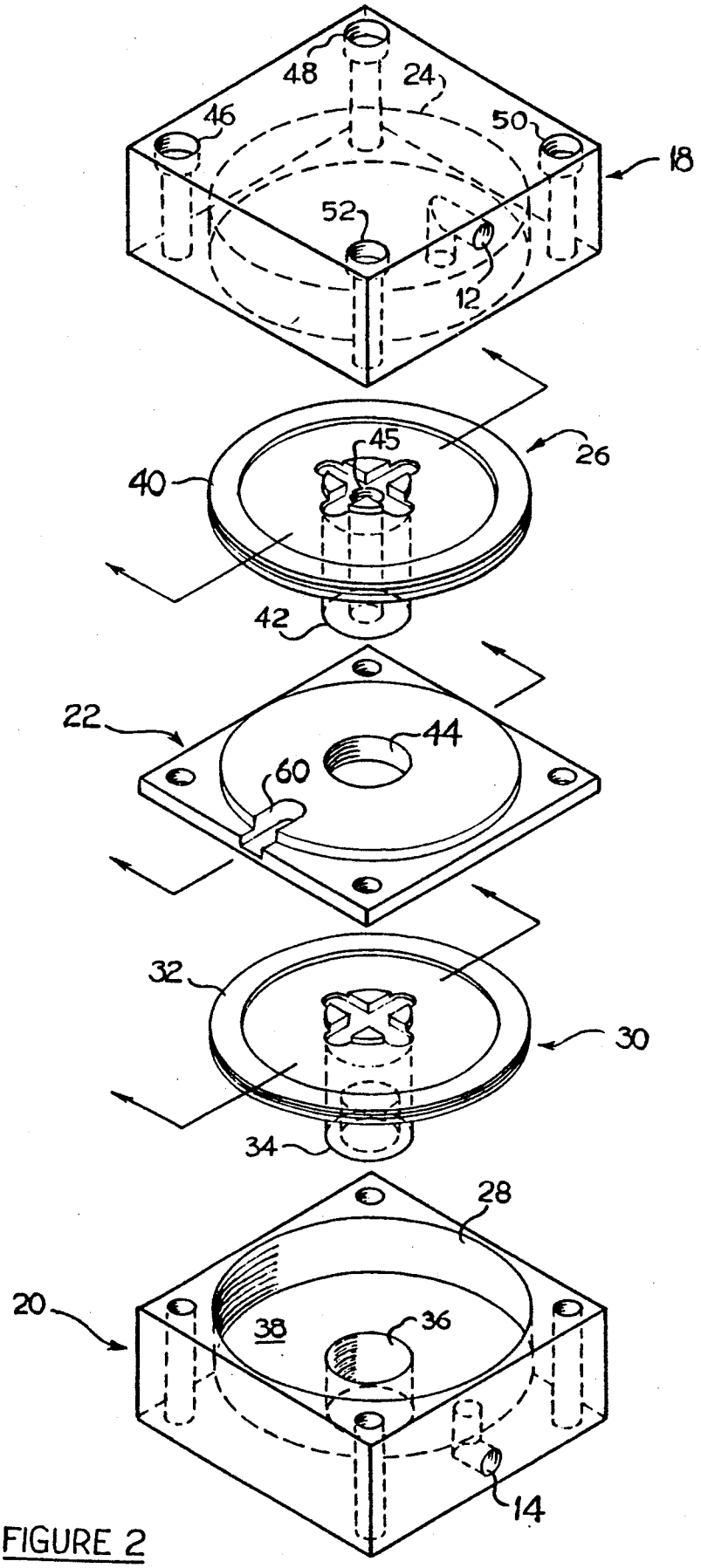
FIG. 2 is an exploded view of one embodiment of the invention, seen from the top.

As more specifically shown in FIG. 2, the cylinder 10 comprises two end wall members 18 and 20 and a partition wall member 22 sandwiched between the two end wall members 18 and 20. The end wall member 18 is provided with a cylindrical recess 24 forming a compression chamber in which a one-piece piston 26 is adapted to slide. The end wall member 20 is also provided with an internal cylindrical recess 28 forming a compression chamber in which the piston 30 is adapted to slide. The end wall member 18 is perforated to provide the air inlet 12 which reaches the cylindrical recess 24 through the top of the latter. Similarly, the end wall member 20 is perforated to provide the air inlet 14 to reach the cylindrical recess 2 from the bottom of the latter. The piston 30 is made in one-piece of a flat circular plate 32 and a cylindrical projection 34 extending from plate 32 and having the same axis as the latter. The diameter of the plate 32 is adapted to sealingly fit inside the cylindrical recess 28 and the projection 34 is adapted to sealingly slide into the aperture 36 in the end wall member 20. The plate 32 is adapted to slide into the recess 28 between its abutting position with the partition wall member 22 and the bottom surface 38 of the recess 28.

The top surface of the plate 32 has four abutting surfaces 29 subdivided by a cross-shaped groove 31. The lower end of the piston 40 is adapted to abut against the four surfaces 29 while the groove 31 allows a fluid communication between both compression chambers formed by the recesses 24 and 28.

The piston 26 is also made of a flat circular plate 40 and a cylindrical projection 42 axially extending from the plate 40. The partition wall member 22 is provided with a central circular perforation 44 in which the cylindrical projection 42 is adapted to sealingly slide. The cylindrical projection 42 is axially perforated by a conduit 45 adapted to allow the air to pass from the recess 24 to the recess 28. The space defined by the recess 28 and the partition wall member 22 defines a first compression chamber while the space define by the recess 24 and the partition wall member 22 constitute a second compression chamber.

The three components 18, 22 and 20 are all provided with holes such as 46–52 in the four corners outside the perimeters of the recesses 24 and 28. Elongated bolts such as 54–58 shown in FIG. 1 are located in the holes 46–52 for fastening all the components together such as shown in FIG. 1. Only the pistons 26 and 30 remain free to move.

In operation, when the air from a pressure valve is introduced into the air inlet 12, the pressure is applied on the upper surface of the flat circular plate 40 and the cylindrical projection 42 is pushed downwardly into the perforation 44 of the partition wall member 22. The air which happens to be confined between the lower surface of the flat plate 40 and the partition member 22 is able to escape through a peripheral slot 60 in the partition wall 22 acting as a vennthole for the second compression chamber. The projection 42 exerts a pressure against the flat circular plate 32. Simultaneously, the air which flows through the conduit 45 and which is spread over the top surface of the plate 32 pushes down the piston 30 due both to the physical pressure of the projection 42 and the air pressure over the plate 32. The projection 34 sealingly slides through the perforation 36 to project outside the cubical part of the cylinder 10 such as shown by the cylindrical portion 16 in FIG. 1. The air in the second compression chamber which was confined between the lower part of the flat plate 32 and the bottom 38 of the recess 28 exits through the outlet 14.

The external pressure exerted by the cylindrical projection 34 results from the combination of pressure of both superposed compression chambers.

As seen in FIG. 1, the outer dimensions of both end wall members 18 and 20 and of the partition wall member 22 are the same so that when the cylinder 10 is assembled, it occupies a relatively small space and provides a neat appearance, easy to clean and to service.

Figure 3:
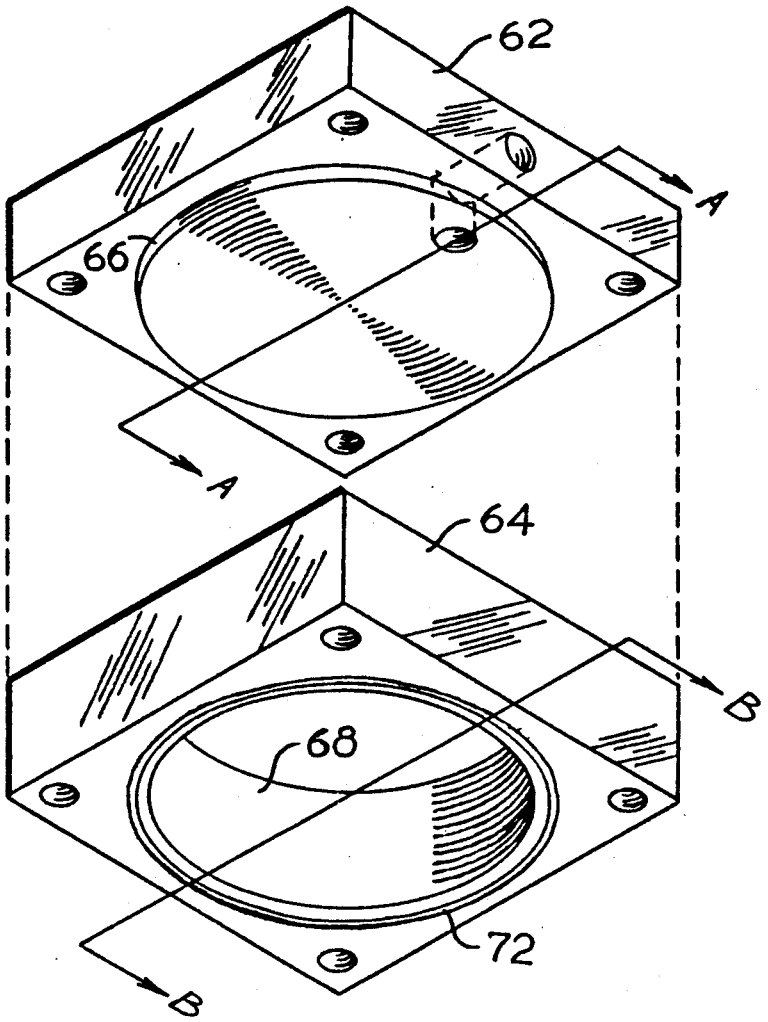
FIG. 3 is an exploded view, seen from the bottom, of an alternative embodiment of the top end wall member.
Figure 4:
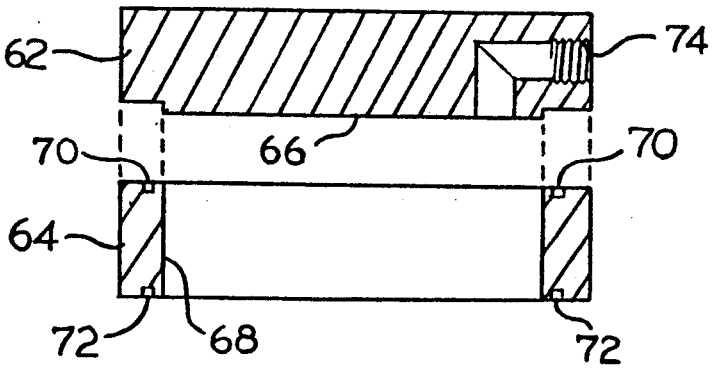
FIG. 4 is a cross-sectional view along lines A—A and B—B of the components shown in FIG. 3.

FIG. 3 illustrates an alternative embodiment of the end wall member 18 when made of two separate parts that is, an end plate 62 and a perforated plate 64. As seen in FIGS. 3 and 4, the plate 62 is substantially flat and has a circular protrusion 66 adapted to fit into the cylindrical bore 68 provided in the plate 64. The bore 66 helps to locate the position of the plate 62 relative to the plate 64. In order to improve the seal between the plates 62 and 64, the plate 64 is provided with a circular groove 70 adapted to receive a sealing ring (not shown). The same plate 64 is also provided with a circular groove 72 also adapted to receive a sealing ring for maintaining the seal between the plate 64 and the partition wall member 22. An air inlet 74 corresponding to the inlet 12 in component 18 extends between the side of the plate 62 and the bore 68 of the perforated plate 64.

The end wall member 20 is preferably subdivided in a similar manner as a end wall member 18 that is, made of an end plate 76 (FIG. 5) having a central cylindrical perforation 78 and an air outlet 80 similar to the outlet 14 shown in FIG. 2. The end plate 76 combined to a perforated plate such as plate 64 shown in FIG. 4 corresponds to the end plate member 20.

Figure 5:
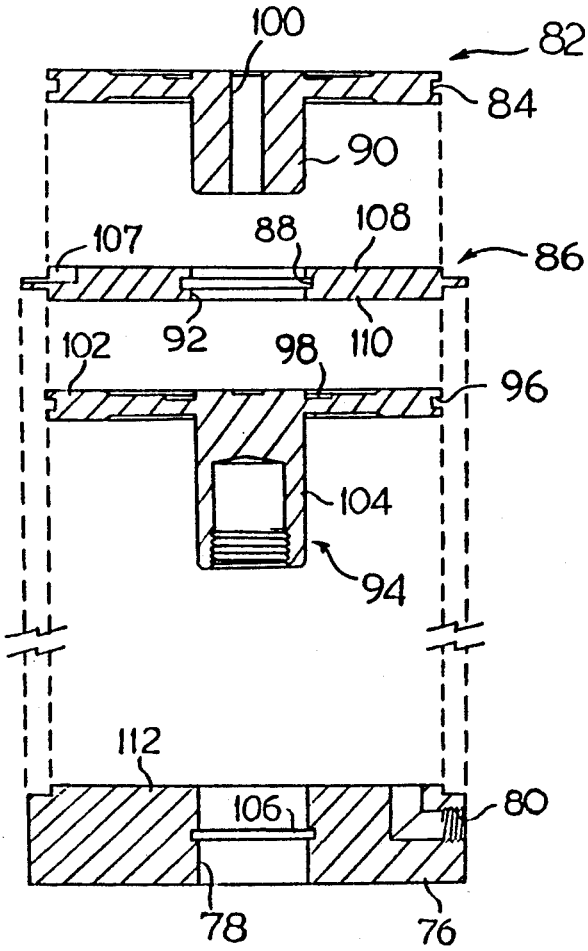
FIG. 5 is an exploded cross-sectional view of alternative embodiment of some components shown in FIG. 2 with the lower flat end plate modified as in FIGS. 3 and 4, FIGS. 6 and 7 are cross-sectional views of two different embodiments of the cylinder when assembled.

FIG. 5 illustrates cross-sectional views of a superposition alternative embodiments of components 26, 22 and 30 respectively shown in FIG. 2. The piston 82 corresponds to the piston 26 but is provided with a peripheral groove 84 adapted to receive a sealing ring for providing a better seal during its sliding movement inside the bore 68. The partition wall member 86 corresponds to the wall member 22 but is provided with an internal groove 88 adapted to receive a sealing ring for providing a better seal between the two adjacent compression chambers while the cylindrical projection 90 of the piston 82 slides through the perforation 92. The piston 94 corresponds to the piston 30 and is additionally provided with a peripheral groove 96 for providing a better seal while sliding in the chamber 38. The piston 94 is also provided with radial grooves 98 on its upper surface so that the air coming down through the conduit 100 can escape below the partition wall 86 when the cylindrical projection 90 abuts against the top surface 102 of the piston 94. A cylindrical projection 104 of the piston 94 is adapted to slide into the cylindrical perforation 78 of the end plate 76. In order to improve the seal in the perforation 78, the latter is provided with an internal groove 106.

The slot 107 shown in the periphery of the partition wall member 86 corresponds to the slot 60 shown in FIG. 2 and will allow the air between the piston 82 and the partition wall member 86 to evacuate when the piston 82 penetrates into the perforation 92.

The partition wall member 86 as illustrated in FIG. 5 is made with an upper and a lower circular protrusion 108 and 110 adapted to fit into the recesses such as 24 and 28 so that it will be automatically centralized and will automatically centralized the perforation 92 and accordingly will allow the perforation 90 to smoothly slide into the perforation 92.

As seen above, all the components can be easily superposed one over the other and centralized due to the protrusion 66, 108 and 110 as well as 112 on plate 76. The perforated plate such as 64 adapted for both end wall members have the same perimeter corresponds to the periphery of the end plates 62 and 76 and the partition wall member 86. The pistons 82 and 94 and the circular protrusion 108, 110 and 112 have the same diameter. It is an obvious elementary operation to assemble all the components of the cylinder.

The multiplication of stages to the cylinder, consists in adding additional pistons such as 82, and additional partition wall members such as 86 above the piston 94 to form additional compression chambers. The only thing which needs to be changed consists in having longer threaded means such as the bolts 54–58 to fasten all the components tightly together.

Figure 6:
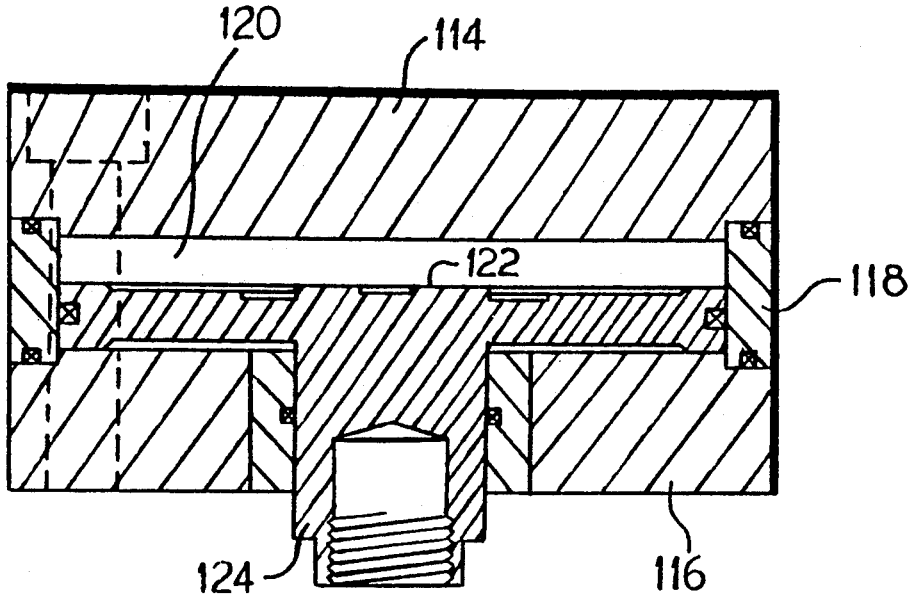

The multi-staged air pressure cylinder according to the invention may also be limited to an one-stage cylinder as illustrated in FIG. 6. This embodiment includes two end plates 114 and 116 and a ring 118 tightly sealed between the two end plates 114 and 116. The compression chamber 120 delimited by the two end plates 114 and 116 and the ring 118 contains a piston 122 adapted to sealingly slide inside the ring 118. The piston 122 has a cylindrical projection 124 adapted to slide through a perforation in the end plate 116 and to exert a forcefull pressure when air is introduced into the chamber 120 in a manner explained in the previous embodiment.

Figure 7:
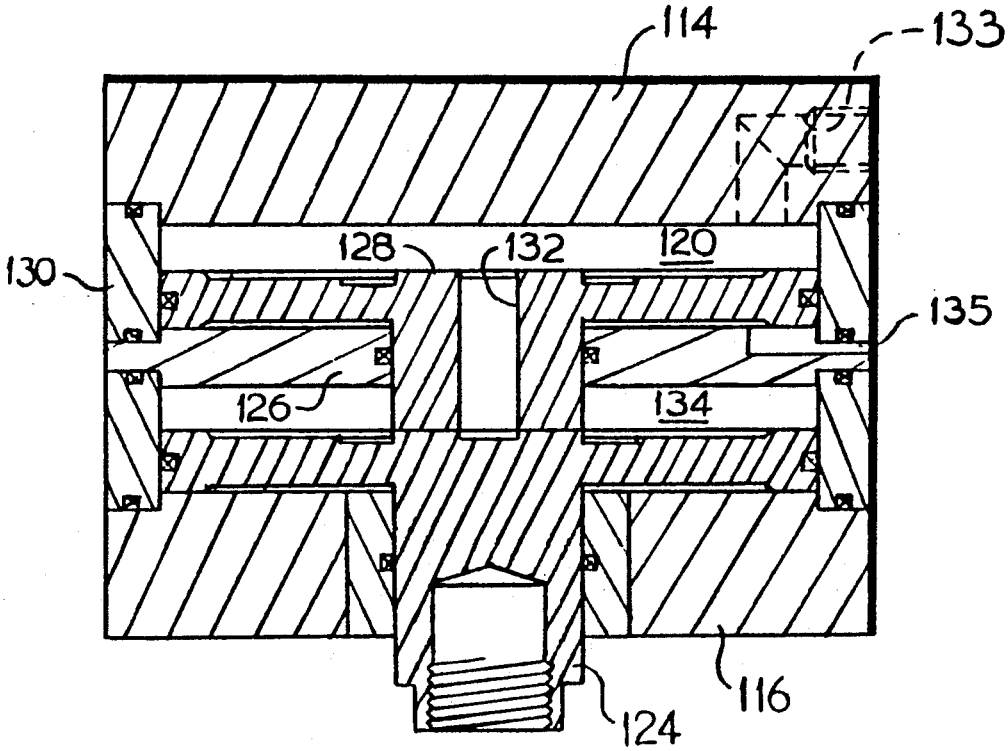

According to the invention, the embodiment described in FIG. 6 can be expanded as shown in FIG. 7 by adding a partition wall member 126 and a piston 128 and an additional ring 130. The piston 128 is provided with a central conduit 132 through which the air coming from the inlet 133 fills the compression chamber 120 enters the conduit 132 to subsequently fill the second compression chamber 134. The venthole 135, corresponding to the slot 60 in FIG. 2, allows the air which is in the chamber 120 under the piston 128, to be expelled for allowing the piston 128 to slide downwardly.

The cylindrical projection 124 can be retracted by reversing the flow of air through the cylinder.

It can be seen from the embodiment shown in FIG. 7 relative to the embodiment the embodiment shown in FIG. 6, that the addition of additional rings such as 130, pistons such as 128 and partition walls such as 126 creates additional compression chambers and provides a multi-stage cylinder according to the invention.

I claim:

1. A multi-stage air pressure cylinder comprising:

a first and second separate end wall members, each provided with a cylindrical recess said end wall members mounted so that the recesses face each other, each of the wall members being provided with an air passage extending outwardly, a flat partition wall member separating both end wall members and both recesses for forming a first compression chamber in the recess of the first end wall member and a second compression chamber in the recess of the second end wall chamber, said partition wall member being provided with a central circular perforation giving access to both chambers, said partition wall member being provided with a vennthole fluidly connecting said second chamber with the surrounding atmosphere outside said cylinder, said venthole being characterized by a portion of the periphery of the partition wall member having a reduced thickness, a one-piece first piston in said first chamber comprising a first circular plate and a first cylindrical projection centrally extending from said first plate on one side thereof, said first circular plate adapted to sealingly slide in said first chamber and said first cylindrical projection adapted to sealingly slide in a central aperture through said first end wall member, a one-piece second piston in said second chamber comprising a second circular plate and a second cylindrical projection centrally extending from said second plate on one side thereof, said second plate adapted to sealingly slide in said second chamber, said second cylindrical projection extending up to said partition wall member and adapted to sealingly slide in the perforation of said partition wall member and having a conduit therethrough for allowing fluid communication between both chambers, said second cylindrical projection adapted to abut against said first circular plate upon introduction of air in said air passages, and fastening means for tightly sealing both end wall members against said partition wall member, whereby an inflow of air pressure in the air passage of said second end wall member causes said second cylindrical projection to abut against the first circular plate of said first piston for projecting said first cylindrical projection through said aperture of said first end wall member, said second piston adapted to close said air passage in said first end wall member for building up pressure in both chambers and applying pressure upon said first cylindrical projection.

2. A multi-stage air pressure cylinder as recited in claim 1, wherein each of said end wall members comprises a flat end plate and a perforated plate adapted to surround each of said recesses, and a sealing ring between said flat end plates and said perforated plates for maintaining air pressure in the cylinder.

3. A multi-stage air pressure cylinder as recited in claim 1, comprising sealing means between the partition wall members and each of the end wall members.

4. A multi-stage air pressure cylinder as recited in claim 2, wherein the partition wall member and each of the flat end plates are provided with a protuberant surface having a circular contour corresponding to the recess for fittingly locating said flat end plates and said partition wall member respectively in said recesses.

5. A multi-stage air pressure cylinder as recited in claim 1, wherein the partition wall member has a sealing ring located around said circular perforation.

6. A multi-stage air pressure cylinder as recited in claim 1, wherein the cylinder has an outer shell around said chambers, said shell being provided with longitudinal channels parallel to the sliding direction of the pistons, screw means adapted to be mounted in said channels for tightening both end walls against the partition wall member.

7. A multi-stage air pressure cylinder as recited in claim 2, wherein the surface of said first circular plate adjacent said second cylindrical projection is provided with radial grooves, said grooves extending between said conduit and said first chamber for allowing a flow of air between said conduit and said first compression chamber when said second cylindrical projection abuts against said first circular plate.

8. A multi-stage air pressure cylinder as recited in claim 2, comprising at least one additional perforated plate, one additional partition wall member and one additional second piston inserted between said flat end plates for providing at least one additional compression chamber, said additional perforated plate, said additional partition wall member and said additional second piston are identical to aforementioned perforated plate, partition wall member and second piston.

9. A multi-stage air pressure cylinder as recited in claim 4, wherein the axial displacement of both of said pistons is equal.

10. An air pressure cylinder comprising a first end plate having a substantially flat face provided with a circular protrusion thereon, a tubular ring freely abutting against said flat end plate, said tubular ring having a circular central aperture fittingly surrounding said protrusion, a first sealing ring located between said tubular ring and said first end plate, a second end plate having a substantially flat face provided with a circular protrusion, said protrusion fittingly corresponding to said circular aperture, said second end plate freely abutting against said tubular ring on the side opposite said first end plate, a second sealing ring mounted between said tubular ring and said second end plate, said second end plate being provided with a circular perforation having its center corresponding to the center of the circular protrusion, the central aperture in said tubular ring delimited by both end plates defining a compression chamber, a piston comprising a circular plate and a cylindrical projection centrally extending from said circular plate, said circular plate adapted to sealingly slide in said aperture against said tubular ring and to sealingly abut against said second end plate when in contact with the latter, and said cylindrical projection adapted to sealingly slide in said perforation, said first and second end plates and said tubular ring each having a peripheral wall surrounding said compression chamber, said peripheral walls being provided with aligned holes adapted to receive tightening bolts for fastening both end plates against said tubular ring, an air inlet and outlet in both end plates for supplying air to the compression chamber, whereby air entering said compression chamber through the inlet in said first end plate pushes against said circular plate to forcefully project the cylindrical projection through said aperture and to maintain said circular plate in contact with said second end plate for closing said outlet.

* * * * *